United States Patent [19]

Mori

[11] Patent Number: 4,841,694

[45] Date of Patent: Jun. 27, 1989

[54] SASH PLATE USED FOR INSERTING A CABLE

[76] Inventor: Kei Mori, 3-16-3-501, Kaminoge, Setagaya-ku, Tokyo, Japan

[21] Appl. No.: 207,149

[22] Filed: Jun. 15, 1988

[30] Foreign Application Priority Data

Jul. 24, 1987 [JP] Japan ..... 62-186279

[51] Int. Cl.[4] ..... E06B 3/00

[52] U.S. Cl. ..... 52/198; 52/242; 52/302; 52/503

[58] Field of Search ..... 350/258–265; 126/439; 52/198, 204, 209, 242, 173 R, 302, 726, 782, 455–458, 503; 49/70, 371

[56] References Cited

U.S. PATENT DOCUMENTS

| | | | |
|---|---|---|---|
| 519,799 | 5/1894 | Thrift | 350/258 X |
| 1,658,855 | 2/1928 | Plym | 52/204 X |
| 2,734,602 | 2/1956 | Dawson | 52/204 X |
| 3,511,559 | 5/1970 | Foster | 350/258 |
| 4,112,645 | 9/1978 | Greenfield | 52/304 |
| 4,297,000 | 10/1981 | Fries | 350/96.24 |
| 4,703,995 | 11/1987 | Mori | 350/96.10 |
| 4,726,159 | 7/1984 | Stohs | 52/99 |
| 4,738,053 | 4/1988 | Biesenthal | 49/70 |

FOREIGN PATENT DOCUMENTS

| | | | |
|---|---|---|---|
| 700411 | 11/1940 | Fed. Rep. of Germany | 52/455 |
| 1474144 | 3/1967 | France | 52/198 |
| 50406 | 3/1984 | Japan | 350/258 |
| 1501297 | 2/1978 | United Kingdom | 350/258 |

OTHER PUBLICATIONS

"Electrical Manufacturing", Sep. 1952, pp. 108, 109.

*Primary Examiner*—David A. Scherbel
*Assistant Examiner*—Caroline D. Dennison
*Attorney, Agent, or Firm*—Jordan and Hamburg

[57] ABSTRACT

A sash plate used for inserting a cable into a room from out of doors. The plate comprises a single thin plate having an upper and lower part with both sides formed as part of a sash's construction and a cable inserting plate of the same width as that of the plate member and having on the upper and lower parts a groove for inserting and firmly fixing the plate member. The plate further has on the approximately central portion a hole for inserting a cable and having on the side portion a notch. The plate member is formed such that the plate member is shorter than the actual length of the sash by an integer of the actual length of the cable inserting plate. An optional desired portion of the plate member is being cut off, and inserted into and firmly fixed onto the groove in order to form a plate of a certain length.

9 Claims, 7 Drawing Sheets

SASH PLATE USED FOR INSERTING A CABLE

BACKGROUND OF THE INVENTION

The present invention relates to a sash plate used for inserting a cable, in particular, a plate preferably employed for installing a cable going from the indoors to the out-of-doors.

The present applicant has previously proposed focusing solar rays by the use of a lens or the like and to guide the same into an optical conductor cable, and then to transmit the guided solar rays through the optical conductor cable onto an optional desired place in order to utilize the solar rays in various ways. And further, the present applicant has proposed to radiate, the solar rays transmitted through the afore-mentioned optical conductor cable, onto the skin's surface of a person for activating its cells as for example, in order to administer medical treatment for curing bedsores.

However, in the case of an old person that is bedridden, the patient stays in bed almost all day long and cannot go out of doors. However, the sun ray collecting device must be installed out-of-doors in order to collect the sun's rays, and the rays collected by the device have to be guided into the room through the afore-mentioned optical conductor cable.

In order to guide the optical conductor cable into the room, a hole is usually made in the wall of a house or building. However, there exists the problem that a suitable spot in the wall cannot always be found and so it can become a major project and cause much damage to the building. Furthermore, in the case that the sun ray collecting device isn't needed after the patient recovers, the hole made in the wall must be closed off so that the work of filling the hole presents a new problem. On the other hand, when a patient is transferred to another room, there must be a new hole provided for inserting the optical conductor cable.

SUMMARY OF THE INVENTION

The object of the present invention is to provide a sash plate used for inserting a cable capable of guiding an optical conductor cable simply into a room from the out of door.

DESCRIPTION OF THE PREFERRED EMBODIMENTS

Figure 1:
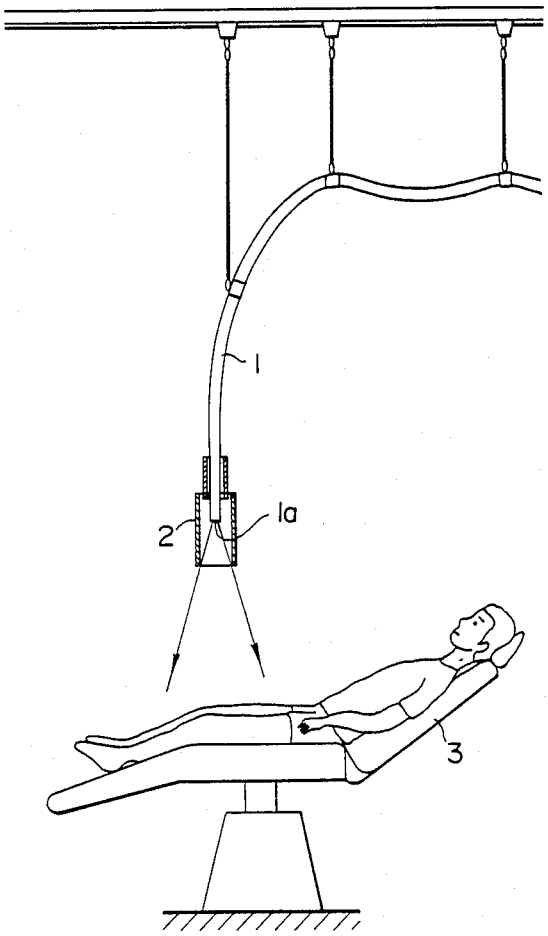
FIG. 1 is a view for explaining an embodiment of a light ray radiation device for use in medical treatment.

FIG. 1 is a construction view for explaining an embodiment of the light ray radiation device for use in medical treatment as previously proposed by the present applicant. In FIG. 1, 1 is an optical conductor cable. At the end portion thereof, not shown in FIG. 1, the sun's rays or artificial light rays are guided into it, and transmitted therethrough. The light rays i.e. the white-colored light rays corresponding to the visible light ray components of the sun's rays, are transmitted through the optical conductor cable as was previously proposed by the present applicant in various ways. In FIG. 1, 2 is a hood member installed at the light-emitting end portion 1a of the optical conductor cable 1, and 3 is a chair for use in medical treatment. At the time of administering medical treatment, a patient is placed in the chair 3 and the light rays, consisting of the visible light ray components, transmitted through the optical conductor cable 1 in the manner mentioned above, are radiated onto the diseased part of a patient.

As mentioned above, the light rays to be radiated onto the diseased part of the patient are the ones corresponding to the visible light ray components of the sun's rays and therefore contain therein neither ultraviolet rays nor infrared rays. Consequently, it may be possible to administer medical treatment safely. However, the above-mentioned light ray radiation device for use in medical treatment is large-scaled and consequently very expensive. In the case of employing such a device in a family setting, the cost would be prohibitive. Furthermore, the usual device would need much space. Those are the problems to be solved.

Figure 2:
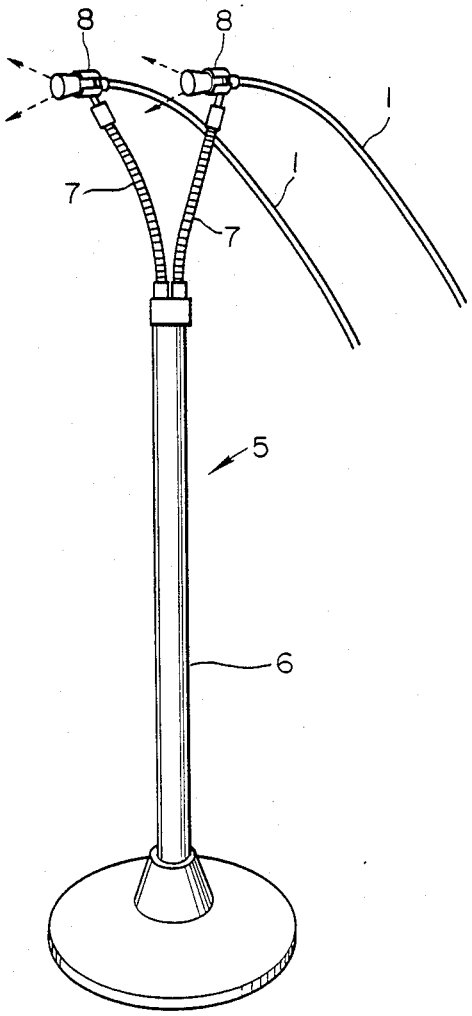
FIG. 2 is an entire perspective view for explaining an embodiment of a light ray radiation stand for use in medical treatment.
Figure 5:
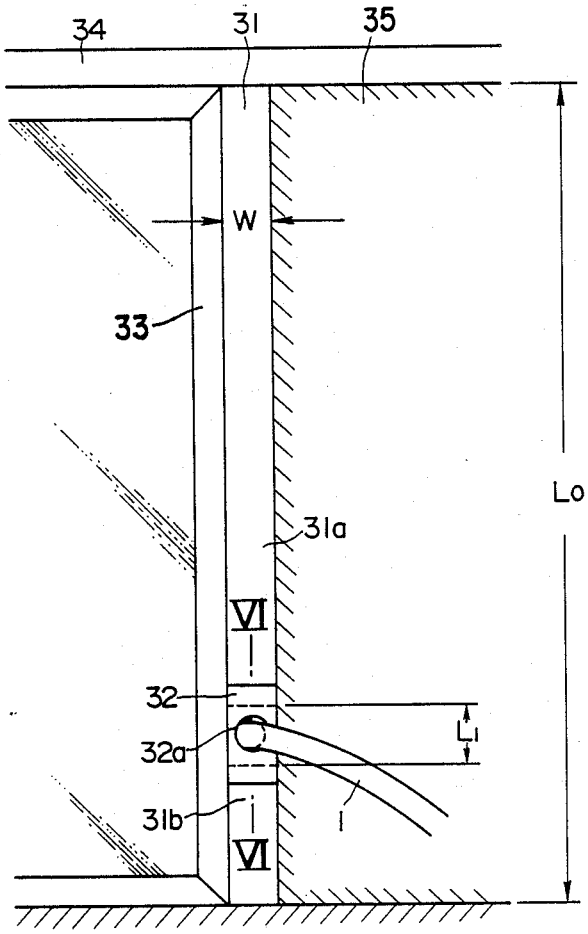
FIG. 5 is an explanatory view showing how to employ a sash plate used for inserting a cable according to the present invention.

FIG. 2 is a perspective view for explaining an embodiment of the light ray radiation stand for use in medical treatment as previously proposed by the present applicant. In FIG. 2, 1 is an optical conductor cable for transmitting therethrough the sun's rays collected by means of a sun ray collecting device not shown in FIGS. 2 and 5 is a light ray radiation stand.

The light ray radiation stand 5 comprises a foundation 6, one or more deformable flexible conduits 7 vertically installed on the foundation 6, and a supporter 8 mounted on the end portion of the conduit 7 and used for detachably supporting the optical conductor cable 1. At the time of employing the light ray radiation device, the end portion of the optical conductor cable 1 is supported by the supporter 8.

According to the afore-mentioned embodiment, since the conduit 7 can be freely deformed and kept in that condition, the radiation from the optical conductor cable 1 can be bent in an optional desired direction. Therefore, the light ray radiation stand can be easily utilized. Furthermore, when the stand is not being used, the optical conductor cable 1 is removed from the stand, and the stand can be put back into a conveniently small space.

Figure 3:
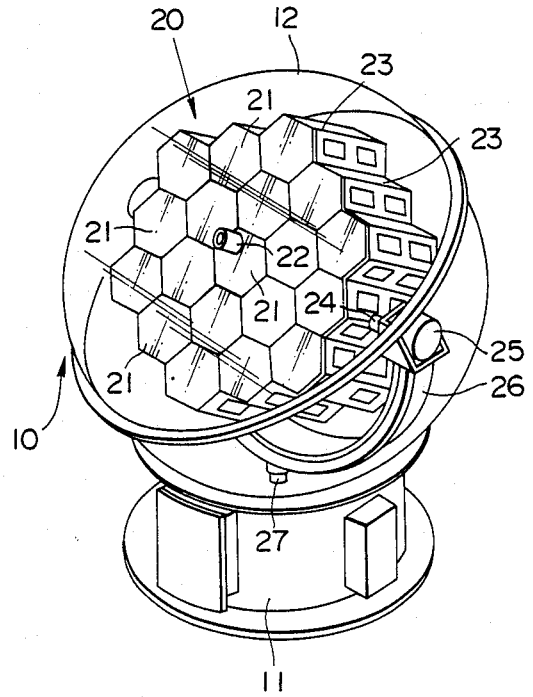
FIG. 3 is a perspective view for explaining an embodiment of a sun ray collecting device used in the present invention.

FIG. 3 is an entire perspective view showing an embodiment of a sun ray collecting device for guiding the sun's rays into the afore-mentioned optical conductor cable 1. In FIG. 3, 10 is a capsule, 11 is a cylindrical foundation, and 12 is a transparent dome-shaped head portion. The capsule 10 for use in the sun ray collecting device is constructed of a fundamental body portion 11 and a head portion 12. As shown in FIG. 3, the sun ray collecting device 20 is accommodated in the capsule 10 when the device is being used.

The sun ray collecting device 20 comprises one lens, several lenses or possibly a large number of lenses 21, a run ray direction sensor 22 for detecting the direction of the sun, a support frame body 23 for unitarily holding the lens 21 and a sensor 22, a first-revolution shaft 24 for rotating the support frame body 23, a first-motor 25 for rotating the first-revolution shaft 24, a support arm 26 for supporting the lens 21, the sensor 22, the support frame body 23, the first revolution shaft 24, and the first motor 25, a second revolution shaft 27 installed so as to intersect the first revolution shaft 24 perpendicularly thereto, and a second motor not shown in FIG. 3 for rotating the second revolution shaft 27.

The direction of the sun is detected by means of a sun ray direction sensor 22 and its detection signal controls the first and second motors so as to always direct the lens 21 toward the sun, and the sun's rays focused by the lens 21 are guided into the optical conductor cable 1, not shown in FIG. 3, the light-receiving end of which is installed at the focal position of the lens 21. The guided light rays are transmitted through the optical conductor cable onto an optional desired place.

Concerning the above-mentioned sun ray collecting device, several types of devices have been proposed heretofore by the inventor. They are devices respectively having a lens or several lenses (2 to 4 lenses) or a large number of lenses (as for instance 7, 19, 61, 196 or as many as 1600 lenses) in accordance with the purpose of its use.

Figure 4:
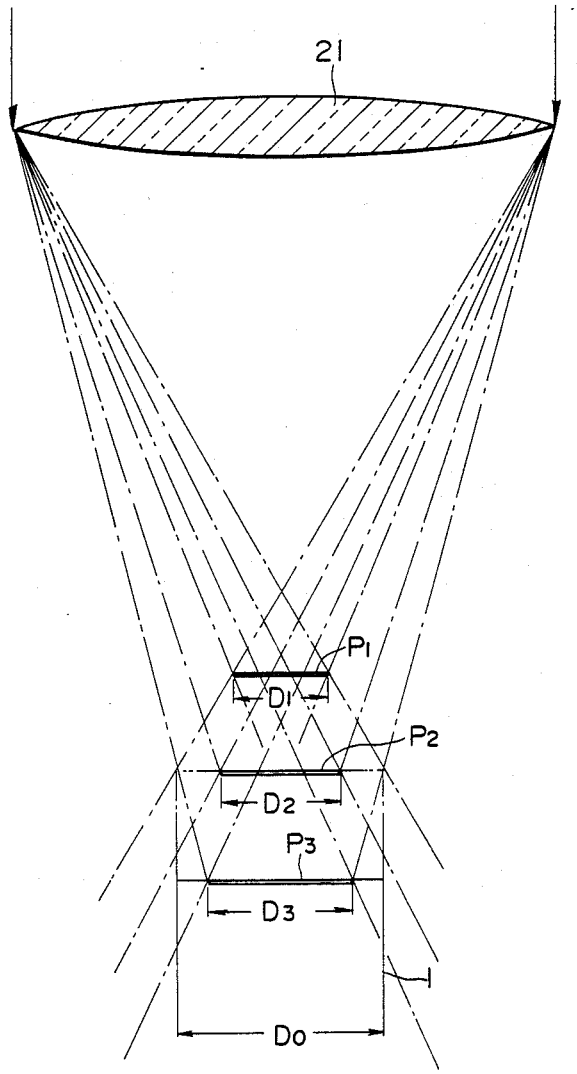
FIG. 4 is a view for explaining a device for guiding the sun's rays into an optical conductor cable.

FIG. 4 is a detailed view for explaining the guiding of light rays that correspond to the visible light ray components of the sun into an optical conductor cable 1. In FIG. 4, 21 is a lens system consisting of a Fresnel lens or the like, and the sun's rays focused by the lens system 21 are guided into an optical conductor cable as mentioned before. In the case of focusing the sun's rays by use of a lens system, the solar image has a central portion consisting of almost white-colored light rays and a circumferential portion containing therein a large amount of light ray components consisting of the wave lengths corresponding to the focal position of the lens system.

Namely, in the case of focusing the sun's rays by the use of the lens system, the position of the lens system and the size of the solar image will vary in accordance with the wave length of the light rays. For instance, the light rays of the color blue, having a short wave length, make a solar image of diameter $D_1$ at position $P_1$. Furthermore, the light rays of the color green make a solar image of diameter $D_2$ at position $P_2$, and the light rays of the color red make a solar image of diameter $D_3$ at position $P_3$.

Consequently, as shown in FIG. 4, when the light-receiving end-surface of the optical conductor cable is put at position $P_1$, it is possible to collect the sun's rays containing plenty of the blue color component at the circumferential portion thereof. When the light-receiving end-surface of the optical conductor cable is put at position $P_2$, it is possible to collect the sun's rays containing plenty of light rays of the green color component at the circumferential portion thereof. When the same is put at position $P_3$, it is possible to collect the sun's rays containing plenty of light rays of the red color component at the circumferential portion thereof. In each case, the diameter of the optical conductor cable is determined by the light ray components to be collected. For instance, the diameters thereof are $D_1$, $D_2$ and $D_3$, respectively, depending on the colors of the light rays to be stressed; i.e. the blue, green and red colors. In such a way, the consumed amount of the optical conductor cable can be reduced, and thereby the sun's rays containing therein plenty of light ray components of the desired color can be collected most effectively. And further, as shown in FIG. 4, if the diameter of the light-receiving end-surface of the optical conductor cable is enlarged to $D_0$, it may be possible to collect visible light rays containing therein all of the wave length components.

As mentioned above, the present applicant has previously proposed focusing solar rays by the use of a lens or the like and to guide the same into an optical conductor cable, and then to transmit the guided solar rays through the afore-mentioned optical conductor cable, onto the skin's surface of a person for activating its cells as for instance, in order to administer medical treatment for curing bedsores.

However, on such an occasion, the patient stays in bed almost all day long and cannot go out of doors. However, the sun ray collecting device must be installed out-of-doors in order to collect the sun's rays, and the rays collected by the device have to be guided into the room through the afore-mentioned optical conductor cable.

In order to guide the optical conductor cable into the room, a hole is usually made in the wall of a house or building. However, there exists the problem that a suitable spot in the wall cannot always be found and so it can become a major project and cause much damage to the building. Furthermore, in the case that the sun ray collecting device isn't needed after the patient recovers the hole made in the wall must be closed off so that the work of filling the hole presents a new problem. On the other hand, when a patient is transferred to another room, there must be a new hole for inserting the optical conductor cable.

FIG. 5 is an explanatory view showing a state of employing a sash plate used for inserting a cable according to the present invention.

In FIG. 5, the reference numeral 31 represents a thin plate having an upper and lower part with both sides formed as part of a sash's construction. The plate is a multi-part plate in that it is separated into two parts 31*a* and 31*b* in the state shown in FIG. 5. The reference numeral 32 represents the cable inserting plate. As shown in FIG. 5, the cable inserting plate 32 is employed in a state of being connected with the separated plate members 31*a* and 31*b* there-between. The cable inserting plate 32 is connected with the plate member 31 so as to be the same size and of the same height as that of the sash.

The reference numeral 1 represents an optical conductor cable inserted through the hole 32*a* formed in the cable-inserting plate 32. The outdoor side of the optical conductor cable 1 is connected with the sun ray collecting device as shown in FIG. 3. The sun's rays transmitted through the sun ray collecting device are radiated onto the end portion at the indoor side of the optical conductor 1. The sun's rays emitted from the optical conductor cable 1 are radiated, for instance, onto the bedsores of a patient as a form of medical treatment.

In FIG. 5, 33 represents a sash leaf, 34 an upper threshold, and 35 a wall surface. The sash plate used for inserting a cable according to the present invention has the same construction as that of the sash leaf 33 as shown in FIG. 5. However, the width W thereof is very narrow, for instance, several centimeters to ten centimeters. Generally, as shown in FIG. 5, the plate, according to the present invention, is constructed such that it is fixedly attached to a wall surface and adjacent thereto, and the sash leaf cannot be opened nor closed.

Figure 6:
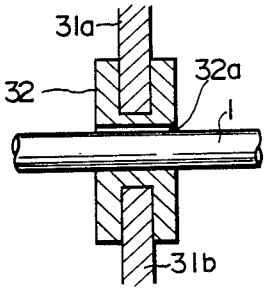
FIG. 6 is an enlarged cross-sectional view taken along the line VI—VI of FIG. 5.
Figure 7A:
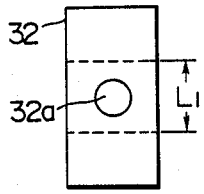
FIG. 7 is a construction view for explaining an embodiment of a cable-inserting plate showing the present invention to best effect.
Figure 7B:
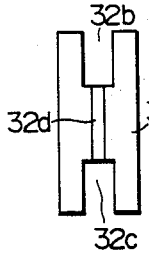
Figure 7C:
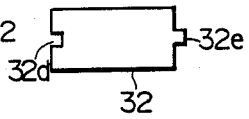
Figure 7D:
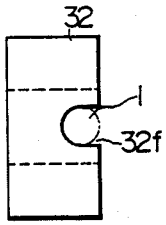
Figure 7E:
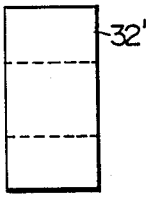

FIG. 6 is an enlarged, cross-sectional view taken along the line VI—VI of FIG. 5. In FIG. 6, the cable inserting plate 32 has grooves on the upper and lower portions thereof. The lower end of the plate member 31*a* and the upper end of the plate member 31*b* are inserted into and fixed onto the upper groove and the lower groove, respectively. A sheet of sash plate is built up with the plates 31*a*, 32 and 31*b*.

FIGS. 7(*a*), 7(*b*) and 7(*c*) are construction views for explaining an embodiment of the cable inserting plate 32. FIG. 7(*a*) is a front view of the cable inserting plate, FIG. 7(*b*) a side view thereof, and FIG. 7(*c*) a top view thereof. The cable inserting plate 32 has a hole 32*a* for inserting therethrough the optical conductor cable 1 in the approximately central portion thereof, and a groove 32*b* for inserting and fixing the lower end portion of the plate member 31*a* in the upper portion thereof, a groove 32*c* for inserting and fixing the upper end portion of the plate member 31*b* in the lower portion thereof, and a hole 32*a* for inserting therethrough the optical conductor cable 1 in the approximate central portion thereof.

Furthermore, the cable inserting plate 32 has a concave portion 32*d* engaged with a convex portion at the right side surface of the sash leaf 33 shown in FIG. 5, and a convex portion 32*e* engaged with a concave portion at the left-side surface of the wall shown in FIG. 5.

Moreover, FIG. 7(*d*) is a construction view showing 35, shown in FIG. 5. the side edge-portion of the cable inserting plate 32 instead of the cable inserting hole 32*a* bored in the approximate central portion of the aforementioned cable inserting plate 32. In such a way, the work of connecting the plate members 31*a* and 31*b* and the cable inserting plate 32 with each other in a state for inserting the optical conductor cable 1 into the cable inserting hole 32*a*, can be omitted. (As circumstances require, the optical conductor cable 1 has to be first inserted into the cable inserting hole 32*a*, and the plate members 31*a* and 31*b* and the cable inserting plate 32 have to be connected with each other maintaining the same conditions.) In such a way, the work of connecting the plate members 31*a* and 31*b* and the cable inserting plate 32 with each other can be facilitated ramarkably.

And further, FIG. 7(*e*) shows a blind plate 32' which has neither the afore-mentioned optical conductor cable inserting hole nor the afore-mentioned notch. The size and construction of the blind plate 32' are quite the same, as those of the afore-mentioned cable inserting plate 32, except that the blind plate 32' has neither the cable inserting hole nor the notch. Such a blind plate is used in place of the cable inserting plate 32, when the sun ray collecting device has no chance of being used, or when the same is temporarily transferred to another place.

Figure 8A:
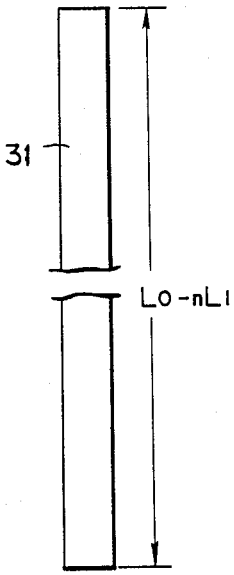
FIG. 8 is a construction view for explaining an embodiment of a plate member showing the present invention to best effect.
Figure 8B:
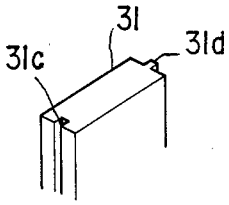

FIGS. 8(*a*) and 8(*b*) are construction views showing the construction of the plate member 31. FIG. 8(*a*) is a front view thereof, and FIG. 8(*b*) a top view thereof. The upper and lower portions and both side portions, etc. of the plate member have the same construction as that of an ordinary sash leaf. For instance, in the embodiment shown in FIGS. 8(*a*) and 8(*b*), a concave portion 31*c* is formed on the left side surfce and a convex portion 31*d* is formed on the right side surface. The concave portion 31*c* is engaged with the convex portion formed on the right side of the sash leaf 33, while the convex portion 31*d* is engaged with the concave portion formed on the left side of the wall portion 35.

In such a construction, supposing that the length of the sash leaf 33 is $L_0$ cm and the distance between both of the grooves of the cable inserting plate 32 is $L_1$ cm, the length of the plate member 31 turns out to be equal to $(L_0-n\cdot L_1)$ cm (here, n is an integer). In the case of employing a single cable inserting plate 32 as mentioned above, namely, where $n=1$ plate member 31 of the length, $(L_0-L_1)$ cm, is employed. If the plate member 31 is cut off at an optional desired position and connected with the cable inserting plate as mentioned above, the entire length of the plate member 31 turns out to be $L_0$ cm, that is a length which is the same as that of the sash leaf 33.

And further, in the case of employing two optical conductor cables, a plate member of the length, $(L_0-2L_1)$ cm, is employed. The plate member may be allowed to be cut off at two optional desired places and to be used in a state of being connected with the cable inserting plate at the respective cut-off places.

An embodiment in which a single cable inserting hole is bored in the cable inserting plate 32 has been described heretofore. However, it may be easily understood that more than two cable inserting holes or notches can be formed in the cable inserting plate 32.

Moreover, although an embodiment in which a sash leaf is opened and closed to the right and to the left has been described heretofore, it may be easily understood that the plate can be constructed quite in the same way even in the case where such a sash leaf is opened and closed in an up and down direction.

Figure 9:
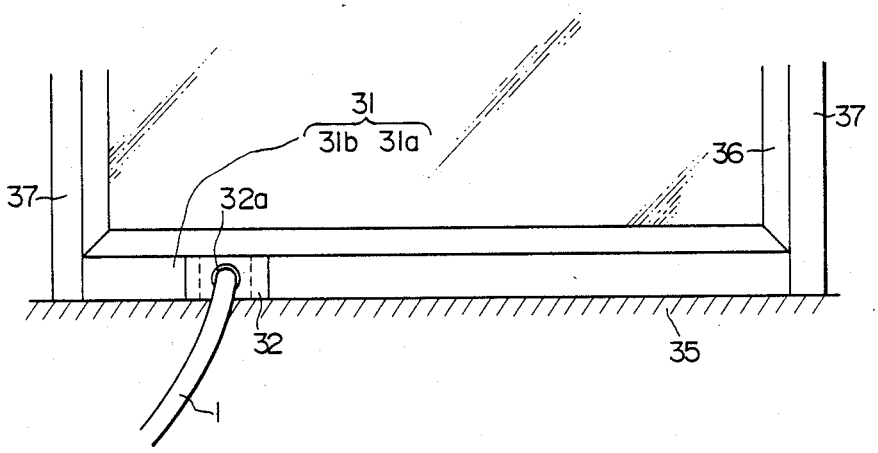
FIG. 9 is a construction view showing an embodiment of a window sash opened and closed in an up and down direction according to the present invention.

FIG. 9 is a construction view showing the embodiment in which a window sash is opened and closed in an up and down direction. In FIG. 9, the same reference numeral as that of FIG. 5 is attached to the part functioning in the same way as that of the embodiment shown in FIG. 5. In FIG. 9, the window sash 36 is opended and closed in an up-and-down direction. Namely, the same is moved up and down along the right-side window frame 37. The plate member 31 and the cable inserting plate 32, etc. are installed under the window sash 36, namely between the window sash 36 and the wall 35, as shown in FIG. 9.

As is apparent from the foregoing description and according to the present invention, a cable can be inserted into and installed in a space between the indoors and the out-of-doors. And further, the height, position and insertion number for inserting the cable can be optionally selected. For this reason, the work of cable installation can be facilitated. These are the advantages of the present invention.

I claim:

1. A sash plate for use between an elongated sash member and a wall and arranged to insertably receive a cable to provide for indoor-outdoor access for said cable comprising a multi-part plate means insertable between said sash member and said wall, said multi-part plate means being elongated in a direction parallel to the elongate direction of said sash member, said multi-part plate means having at least two plate parts, one of said plate parts having a first longitudinal end and another of said plate parts having a second longitudinal end, said first and second longitudinal ends being separated from one another to define a space therebetween, a cable insertion plate disposed in said space, said insertion plate having a first end portion with a first groove and a second end portion with a second groove, said first longitudinal end of said first plate part being fixed in said first groove and said second longitudinal end of said other plate part being fixed in said second groove such that said plate parts and said insertion plate define a built-up sash plate having an elongate length substantially equal to the elongate length of said sash member, said insertion plate and said multi-part plate means each having the same width in a direction perpendicular to said elongate direction, said insertion plate having a cable-opening means insertably receiving a cable thereby providing for indoor-outdoor access for said cable.

2. A sash plate according to claim 1, wherein said cable-opening means comprises at least one opening in said insertion plate.

3. A sash plate according to claim 2, wherein said cable-opening means comprises a plurality of said openings.

4. A sash plate according to claim 1, wherein said insertion plate has longitudinal edges, said cable-opening means comprising at least one notch opening up onto at least one of said longitudinal edges.

5. A sash plate according to claim 4, wherein said cable-opening means comprises a plurality of said notches.

6. A sash plate according to claim 1, wherein said insertion plate has two longitudinal edges, a concave channel extending along one of said longitudinal edges, and a convex protrusion extending along the other of said longitudinal edges, said channel and said protrusion being adapted to mate with a respective mating projection and groove on said sash member and said wall.

7. A sash plate according to claim 6, wherein said first and second grooves extend between said two longitudinal edges, said first and second grooves each having a bottom, said channel and said protrusion extending between the respective bottoms of said first and second grooves.

8. A sash plate for use between an elongated sash member and a wall comprising a multi-part plate means insertable between said sash member and said wall, said multi-part plate means being elongated in a direction parallel to the elongate direction of said sash member, said multi-part plate means having at least two plate parts, one of said plate parts having a first longitudinal end and another of said plate parts having a second longitudinal end, said first and second longitudinal ends being separated from one another to define a space therebetween, an insertion plate disposed in said space, said insertion plate hving a first end portion with a first groove and a second end portion with a second groove, said first longitudinal end of said first plate part being fixed in said first groove and said second longitudinal end of said other plate part being fixed in said second groove such that said plate parts and said insertion plate define a built-up sash plate having an elongate length substantially equal to the elongate length of said sash member, said insertion plate and said multi-part plate means each having the same width in a direction perpendicular to said elongate direction whereby the insertion plate is adapted to insertably receive a cable, thus providing access for the cable on each side of the sash member.

9. A sash plate according to claim 8, wherein said insertion plate has two longitudinal edges, a concave channel extending along one of said longitudinal edges, and a convex protrusion extending along the other of said longitudinal edges, said channel and said protrusion being adapted to mate with a respective mating projection and groove on said sash member and said wall, said first and second grooves extending between said two longitudinal edges, said first and second grooves each having a bottom, said channel and said protrusion extending between the respective bottoms of said first and second grooves.

* * * * *